United States Patent [19]

Karkkainen

[11] 4,261,127

[45] Apr. 14, 1981

[54] SAFETY LOCK FOR FIREARMS

[76] Inventor: Alpo Kärkkäinen, Iiksi Kp 2, 80910 Kulho, Finland

[21] Appl. No.: 39,875

[22] Filed: May 17, 1979

[30] Foreign Application Priority Data

May 24, 1978 [FI] Finland ..... 781653

[51] Int. Cl.[3] ..... F41C 17/08

[52] U.S. Cl. ..... 42/1 LP

[58] Field of Search ..... 42/1 LP

[56] References Cited

U.S. PATENT DOCUMENTS

| | | | |
|---|---|---|---|
| 633,939 | 9/1899 | Ackerman | 42/1 LP |
| 2,945,316 | 7/1960 | Mulno | 42/1 LP |
| 3,553,877 | 1/1971 | Welch et al. | 42/1 LP |
| 4,136,475 | 1/1979 | Centille | 42/1 LP |

*Primary Examiner*—Charles T. Jordan

*Attorney, Agent, or Firm*—J. Harold Nissen

[57] ABSTRACT

The invention relates to a device for locking a firearm preferably provided with a wooden stock (1) comprising a so called pistol end. The locking device according to the invention comprises a cylinder lock (4) mounted from beneath into the pistol end of the stock (1) behind the trigger (2) and mechanical means preferably comprising a flexible shaft (5) for transmitting the movement of a turnable element of the cylinder lock from the cylinder lock (4) to a member (6) essential for the function of the firing device of the arm.

4 Claims, 4 Drawing Figures

SAFETY LOCK FOR FIREARMS

Figure 1:
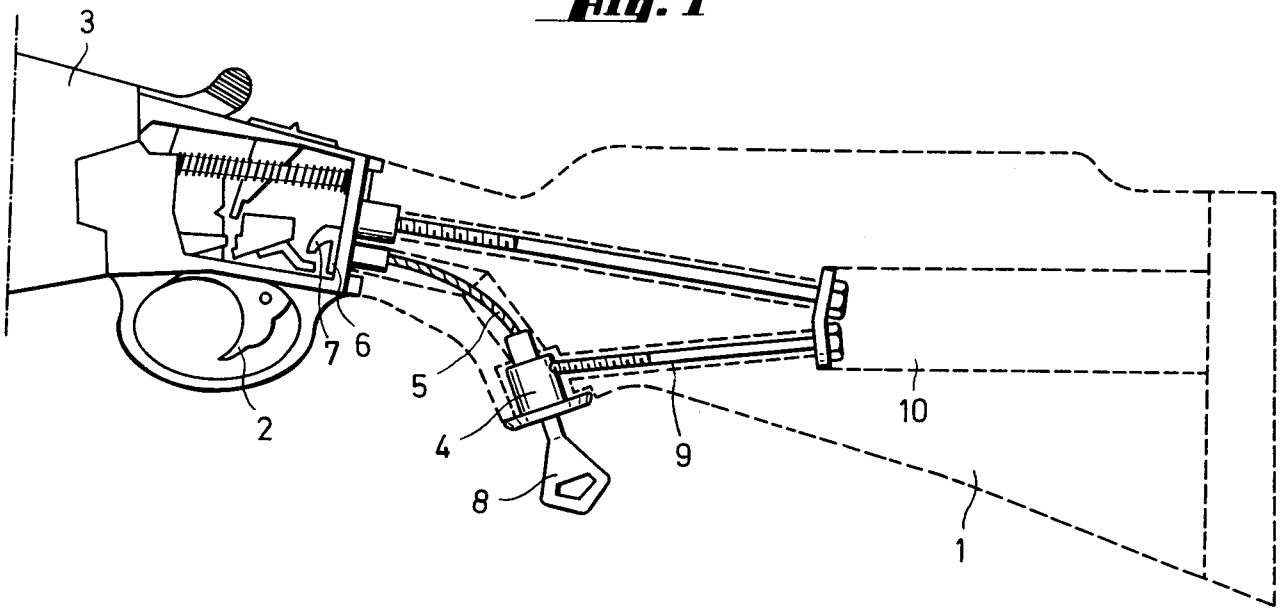

The invention relates to a device for locking a firearm preferably provided with a wooden stock.

It is known per se to provide a firearm with a locking device, but the known locking devices are usually detached or for instance firmly attached to an arm stand or to a corresponding depository. Thus, it at least has not been easy to lock the arm any time, for instance, when transporting it from one place to another or when the arm is temporarily left somewhere.

The object of the invention is to provide a locking device which can be attached in the arm all the time so that it is always usable for locking the function of the arm. The locking device according to the invention comprises a cylinder lock, which is mounted in the stock of the arm preferably from beneath into the pistol end of the stock behind the trigger and mechanical means for transmitting the movement of a turnable element of the cylinder lock from the cylinder lock to a member essential for the function of the firing device. The term "a member essential for the function of the firing device" means a member, certain position or movement of which is necessary for causing the firing function. On the other hand, said member does not necessarily have to be part of the actual firing mechanism. It can also be some secondary member, the operation of which, however, is essential for the function of the firing mechanism.

According to the invention the locking device is always attached to the arm and can be operated with the ordinary key of the cylinder lock. Thereby the advantage is obtained that the arm can functionally be locked all the time when it is not used or when it is left somewhere unguarded. The mechanical elements connecting the cylinder lock to the firing device can advantageously comprise a flexible axle by means of which the cylinder lock is connected to the member locking the function of the firing device. The use of the flexible axle brings the advantage that the locking device according to the invention can easily be modified to be applicable to different types of arms.

The cylinder lock of the locking device can be fixed into the stock of the arm with a screw arranged through the stock, preferably with a screw the end of which is in a recess at the rear of the stock. In order to secure the fixing it is recommendable to construct the head of the fixing screw located in the cylinder lock in such a manner that it, in cooperation with a suitable guiding surface in the cylinder lock, forms a mechanism preventing the unscrewing of the fixing screw when the lock is in its locking position. Alternatively the fixing of the cylinder lock can be secured so that the cylinder lock comprises a mechanism, known per se, locking the cylinder lock to its place when it is in a locking position of the firing function of the arm. Both embodiments bring the advantage of making it impossible to remove the cylinder lock when the arm is locked without breaking the stock of the arm.

It is recommendable that the cylinder lock of the locking device is of such a type that the key can be removed from the lock both in its opening position and in its locking position. Thereby the advantage is obtained that the key never is in the way when shooting with the arm. Then the key cannot be easily forgotten in the lock either so that it could be stolen. This serves for improving the reliability of the locking system.

Figure 2:
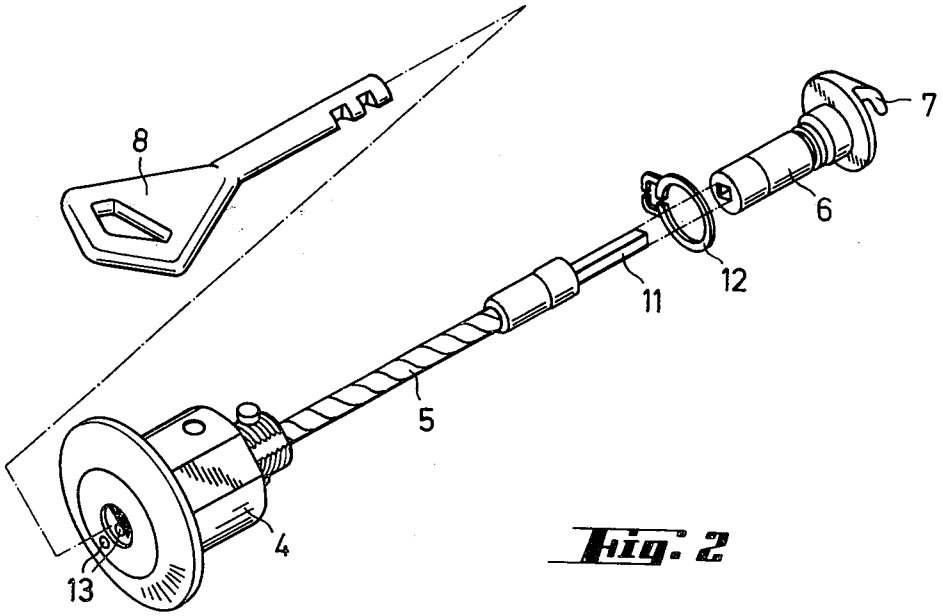
Figure 3:
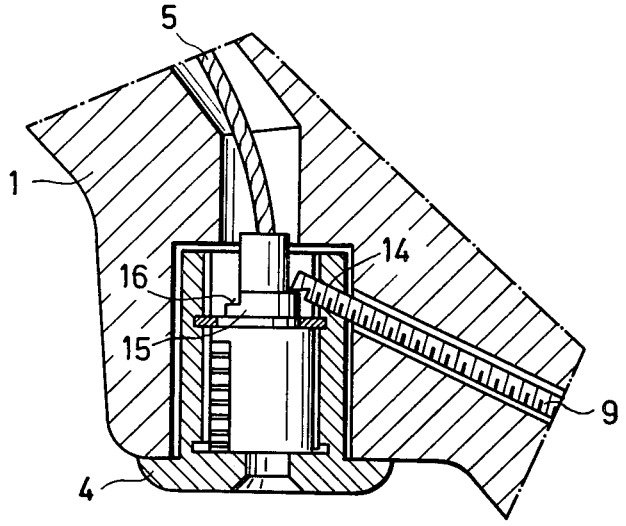
Figure 4:
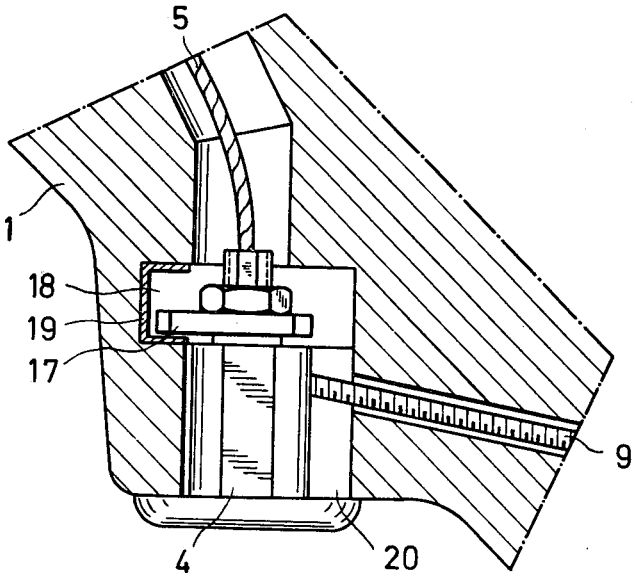

In the following, the invention is described more in detail with reference to the attached drawing, in which FIG. 1 shows a longitudinal section of the rear part of the firearm according to the invention, FIG. 2 shows an exploded view of the essential parts of the locking device, FIG. 3 shows a sectional view of one embodiment of the attachment of the cylinder lock, FIG. 4 shows a sectional view of another embodiment of the attachment of the cylinder lock.

In the drawing, the numeral 1 indicates the stock of a firearm, the form of which is sketched by a broken line. The numeral 2 indicates the trigger and 3 the barrel of the firearm. The stock is provided with a cylinder lock 4, which is mounted from beneath into the pistol end located in the stock behind the trigger and the turnable inner cylinder of which is by means of a flexible shaft 5 connected to a turnable member 6 in the firing mechanism, said member 6 including a hook 7, which in a certain position prevents the function of the firing device. By turning the inner cylinder of the cylinder lock with a key 8 of the cylinder lock 4, the member 6 turns so that the hook 7 takes a position releasing the firing mechanism. Thus, by means of the cylinder lock the function of the firearm can be locked and released in a desired way. The use of the firearm is in no way impaired by the cylinder lock, because it is completely mounted within the stock. The key 8 of the lock is in the lock only when unlocking and locking it.

Cylinder lock 4 is fixed to its place by means of a fixing screw 9, the end of which is in a bore 10 in the rearmost part of the stock. The attachment can be secured in different ways. Two alternative embodiments are shown in FIGS. 3 and 4.

FIG. 2 shows the essential elements of the locking device itself. The flexible shaft 5 is fixed in the inner end of the cylinder lock 4 connecting the lock by means of a rectangular shaft 11 to the turnable locking member 6, the hook 7 of which locks and releases the firing mechanism of the firearm as is explained above. The locking device comprises also a locking ring 12 to keep the turnable locking member 6 in its place.

The construction of the cylinder lock 4 is such that the key 8 of the lock can be released from the lock in two different positions one corresponding to the locking position and the other the functional position of the firearm. The outer end of the cylinder lock is provided with two markpoints 13 to indicate the position of the lock.

FIG. 3 shows an alternative embodiment for fixing the cylinder lock 4. The fixing screw 9, which is shown entirely in FIG. 1, is connected with a screw joint 14 to the cylinder 4. The inner end of the screw 9 is provided with a recess which, together with a shoulder 15 connected to the turnable inner cylinder of the lock, functions as a mechanism preventing the turning of the screw 9 when the cylinder lock 4 is in the locked position shown in FIG. 3. When the cylinder lock 4 is opened and its inner cylinder is turned half a turn, a recess 16 in the shoulder 15 moves at the position of the fixing screw 9 and then the screw 9 can freely be turned. Thus, the lock 4 cannot be removed from the firearm if it has not first been opened.

FIG. 4 shows another way of fixing the cylinder lock 4. The inner end of the cylinder lock is provided with a bar 17, turnable in a known way, locking the lock at the locking position thereof. The stock 1 of the firearm includes a cut 18 for the bar 17. The cut 18 can be strengthened by means of a metal element 19. The cylinder lock is mounted in the stock, the bar 17 being turned half a turn from the position shown in FIG. 4, whereby the outer end of the bar 17 is able to move in the mounting groove 20, which preferably is considerably more narrow than the outer part of the cylinder housing of the cylinder lock 4 mounted in the stock 1 so that it would not much weaken the strength of the mounting of the cylinder lock.

The invention is not limited in the embodiments shown but several modifications are feasible within the scope of the attached claims.

I claim:

1. A device for locking a firearm preferably provided with a wooden stock comprising a so called pistol end, said locking device comprising a cylinder lock mounted from beneath into the pistol end of the stock behind the trigger and mechanical means preferably comprising a flexible shaft for transmitting the movement of a turnable element of the cylinder lock from the cylinder lock to a member essential for the function of the firing device of the arm, said cylinder lock being fixed to the stock of the arm with a screw arranged through the stock, preferably with a screw the end of which is in a recess at the rear of the stock.

2. A device according to claim 1, wherein the end of the fixing screw of the cylinder lock located in the cylinder lock is so formed and the cylinder lock is provided with such a guiding surface that when the lock is in a locking position said fixing screw cannot be turned.

3. A device according to claim 1, wherein the cylinder lock is provided with a mechanism, known per se, locking the cylinder lock to its place when the lock is in a position locking the firing function of the arm.

4. A device according to claim 2 or 3, wherein the cylinder lock is of such a type that the key of the lock can be removed from the lock both in its opening position and in its locked position.

* * * * *